United States Patent [19]

Stuff

[11] Patent Number: 4,530,505

[45] Date of Patent: Jul. 23, 1985

[54] GOLF CLUB HEAD

[76] Inventor: Alfred O. Stuff, 1176C Paseo Del Mar, Casselberry, Fla. 32707

[21] Appl. No.: 440,272

[22] Filed: Nov. 9, 1982

Related U.S. Application Data

[60] Continuation-in-part of Ser. No. 393,643, Jun. 30, 1982, Pat. No. 4,423,874, which is a division of Ser. No. 231,981, Feb. 6, 1981, Pat. No. 4,340,229.

[51] Int. Cl.[3] ..... A63B 53/08

[52] U.S. Cl. ..... 273/164; 273/175; 273/172

[58] Field of Search ..... 273/175, 167 J, 173, 273/164, 183 D, 162 B, 171, 172, 183 E, 167 A

[56] References Cited

U.S. PATENT DOCUMENTS

| | | | |
|---|---|---|---|
| 2,976,046 | 3/1961 | McCullough | 273/162 B |
| 3,909,004 | 9/1975 | Vella | 273/162 B |
| 4,340,229 | 7/1982 | Stuff | 273/183 E X |
| 4,413,825 | 11/1983 | Sasse | 273/175 |
| 4,423,874 | 1/1984 | Stuff | 273/171 |

FOREIGN PATENT DOCUMENTS

| | | | |
|---|---|---|---|
| 124891 | 7/1947 | Australia | 273/171 |
| 25564 | of 1905 | United Kingdom | 273/167 J |

*Primary Examiner*—George J. Marlo
*Attorney, Agent, or Firm*—William M. Hobby, III

[57] ABSTRACT

A golf club head (12) for a putter or chipper having a sighting device (16, 50, 44, 45) by which the golfer may easily align the club head to maintain its horizontal plane (31) parallel with the putting surface. The sole plate of the club head (12) is relieved by including two ribs (21, 22) extending from club face portion (13) to the rear of the club head to minimize dragging and scuffing on the grass of the putting surface during a stroke. Recesses (24) in the relieved areas are adapted to receive selectable size weights (26) which permit the weight of the club head to be adjusted to suit the individual and to also balance the head or to vary the heel-to-toe weight ratio. One golf club head (60) has a face (63, 70) having a plurality of deep vertical grooves (64, 72) therein between 1/32 and ⅛ inch wide, spaced by ribs (65, 71) to reduce the impact area of a golf ball with the golf club face (63, 70) to reduce back-spin and skidding of the golf ball.

1 Claim, 21 Drawing Figures

FIG. 1
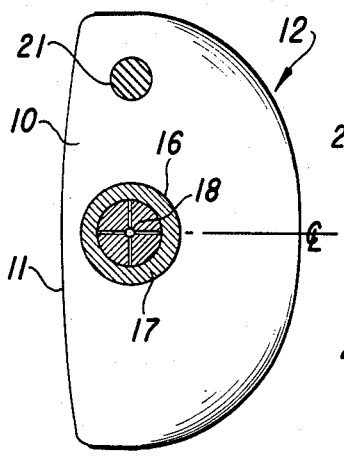
FIG. 2
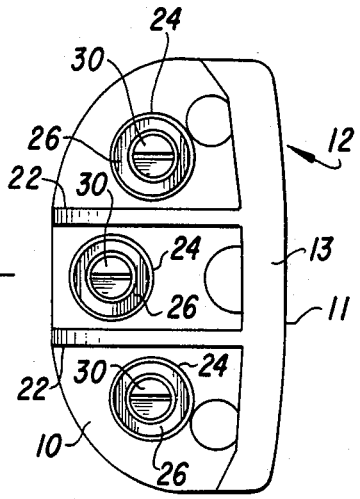
FIG. 3
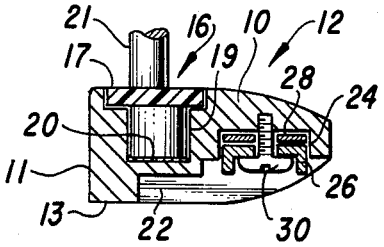
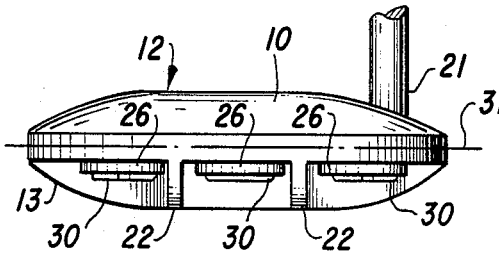
FIG. 4
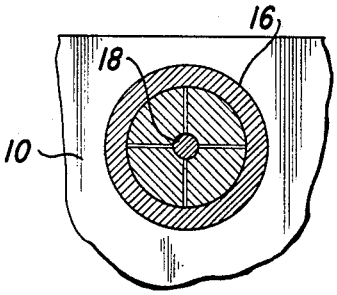
FIG. 5
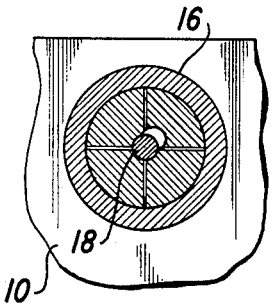
FIG. 6
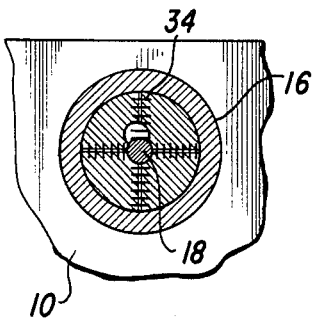
FIG. 7

FIG. 8
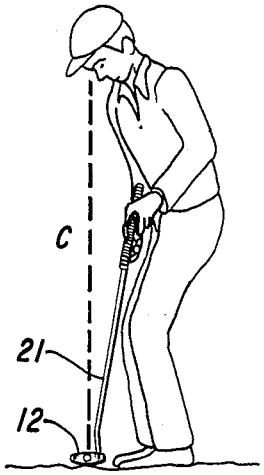
FIG. 9
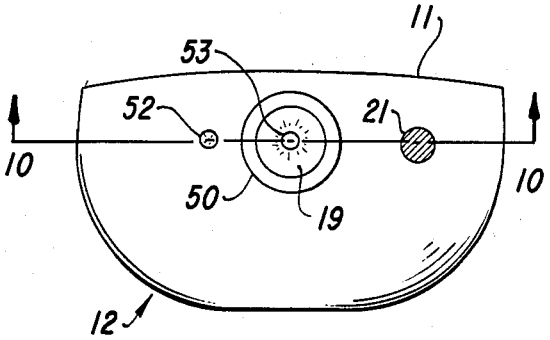
FIG. 10
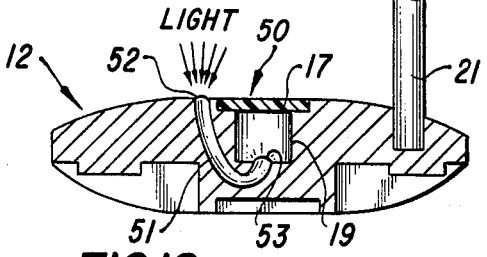
FIG. 11
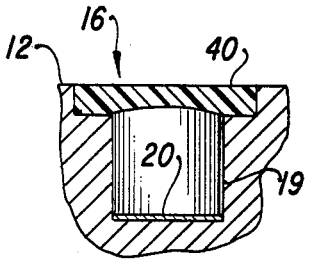
FIG. 12
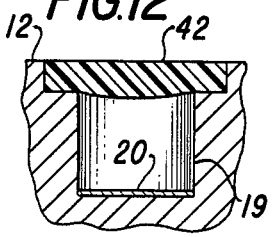
FIG. 16
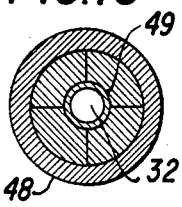
FIG. 13
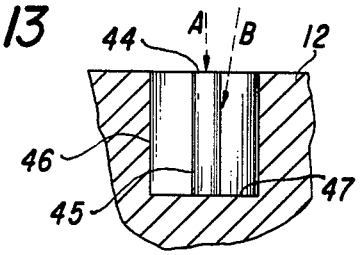
FIG. 14
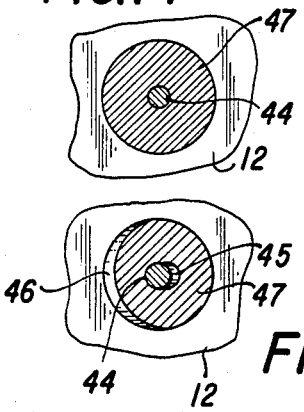
FIG. 17
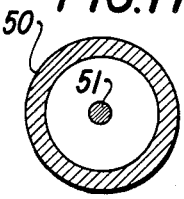
FIG. 15

GOLF CLUB HEAD

This application is a continuation-in-part of my prior patent application Ser. No. 393,643 filed June 30, 1982, now U.S. Pat. No. 4,423,874, which is a divisional of patent application Ser. No. 231,981 filed Feb. 6, 1981, now U.S. Pat. No. 4,340,229.

BACKGROUND OF THE INVENTION

Field of the Invention

The present invention relates to an improvement in golf clubs and more particularly to an improvement in a putter's chipper.

There are several important factors that a golfer must consider in making a putt. First, he must take care to strike the ball with the club face at the center of percussion for the head; otherwise, force vectors may be imparted at a direction other than the desired line of roll of the ball. Similarly, he must maintain the horizontal plane of the club parallel with the surface of the green to prevent departures from the line of roll. The golfer must also be able to accurately align the club face at right angles to the direction in which he wishes the ball to go. While these requirements are basically under the control of the golfer, there are requirements in the design of the club which the golfer has little or no control. For example, the club and club head must be properly balanced so that the dynamic forces during a swing do not cause a change in the alignment of the club face with respect to the ball and the line of roll. Also, the drag of the grass during the stroke on the sole plate of the club can, on occasions, introduce changes in the alignment of the club just prior to striking the ball.

There have been a number of designs of putter heads which have attempted to solve some of these problems, but none which assist the golver in overcoming all of the above mentioned problems. U.S. Pat. No. 2,478,468 to Drake has approached the balance problem by offsetting the head with respect to the shaft and has attempted to improve the scuffing problem by the curvature of the sole plate portion. Handzlik, Jr., in U.S. Pat. No. 2,991,082 has provided a putter head construction having a raised portion adjacent the so called "sweet spot" of the face of the club to indicate to the golfer the proper point for striking the ball. Another alignment effort was made by Hodge in U.S. Pat. No. 3,486,755 in which the putter was to be used in the manner of a shuffleboard club. However, none of the referenced patents, or of clubs known in the prior art, have provided any assistance to the golfer to maintain the horizontal plane of the club parallel with the surface of the green. Thus, he must depend entirely on judgement and experience with respect to this requirement for accurate putting.

SUMMARY OF THE INVENTION

In the present invention, I have provided a novel golf putter or chipper head which can be accurately balanced and tailored to the individual golfer. The head is designed to greatly minimize the drag or scuffing of the sole plate of the club during stroke. My club head also has a built in alignment device which will permit the golfer to very easily hold his putter with the horizontal plane of the club exactly parallel to the green. This same gold club head has a face having a plurality of deep recessed vertical slots therein which may be between 1/32 and ⅛ inch in width and spaced between a golf ball.

The slots are of sufficient depth to prevent comfort with a golf ball upon impact, which minimum depth depends upon the width of the slot. The slots may be at least 1/16 inch deep or 1/16 inch inch slots. The slots prevent back-spin and skidding of the golf ball.

BRIEF DESCRIPTION OF THE DRAWINGS

FIG. 1 is a top view of the putter head of my invention showing the appearance of one version of the sighting device;

FIG. 2 is a bottom view showing the sole portion of my gold putter head indicating the position of the balance weights;

FIG. 3 is a cross-sectional view of the golf putter head showing the sighting device cavity and details of the balance weights;

FIG. 4 is a rear view of the golf putter head showing the rib construction;

FIG. 5 shows a part of the top surface of the club head with the sighting device aligned with the horizontal plane of the club head parallel to the ground;

FIG. 6 shows the sighting device of FIG. 5 as it appears with the club not parallel to the ground;

FIG. 7 shows a sighting device having calibration lines such that a deliberate pull, push, slice or hook may be generated;

FIG. 8 shows a golfer using the sighting device to align the club;

FIG. 9 shows an alternative sighting device utilizing fiber optics to produce a bright spot;

FIG. 10 is a cross section of the club head of FIG. 9;

FIG. 11 shows an alternative sighting device having the upper disc in the form of a concave lens;

FIG. 12 shows another alternative sighting device in which the upper transparent disc is in the form of a convex lens;

FIG. 13 shows another alternative sighting device in which a cylindrical post is utilized;

FIG. 14 shows the sighting device of FIG. 13 in the top of a club which is being properly held to mantain the club parallel with the green;

FIG. 15 shows the sighting device of FIG. 10 in which the club is not being held parallel with the putting surface;

FIGS. 16 and 17 show two alternative upper shot designs for the sighting device of FIG. 1.

DETAILED DESCRIPTION OF THE PREFERRED EMBODIMENT

Figure 18:
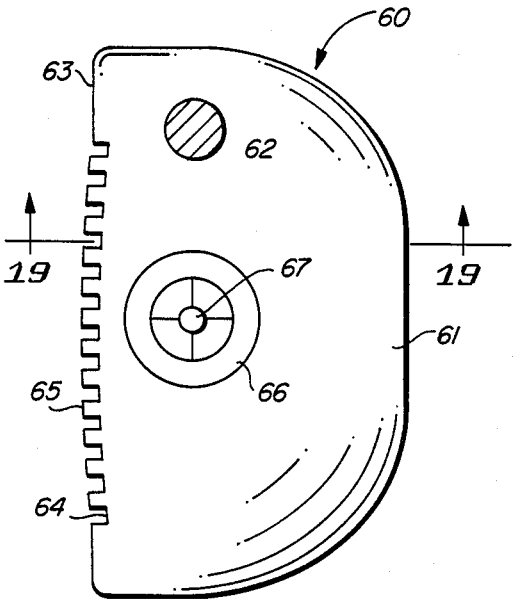
FIGS. 18, 19 and 21 show two aternative embodiments having vertical grooves in the face of the club head.

The construction of my improved golf putter head may be noted from FIGS. 1 through 4. Although the main body portion (12) may be cast from any desired metal, I prefer to utilize zinc for economy. The top surface of the club head seen in FIG. 1 shows the location of the attachment of the shaft (21) and, as illustrated, is for a left handed golfer. As will be seen, the casting (12) has an approximate "D" shape and is symmetrical; thus the opening in the head for shaft (21) would be at the opposite end for a right hand club. At the center of the top surface (10) and adjacent to the center of the club face (11) may be noted sighting device (16) having a black outer ring (17) and a black inner spot (18) connected by cross hairs to black ring (17). The spot (18) as aligned with the fore and aft center line of the club which intersects the area on the club face (11) with which the bal should be struck. The sole plate of head (11) is shown in the bottom view of FIG. 2. A narrow transverse portion (13) of the casting may be noted extending rearward from the club face (11) and may also be seen in cross-section in FIG. 3. Two ribs (22) extend from the club face portion (13) to the rear of the club head (12) having an upward curvature toward the rear as best seen in FIG. 3. This construction minimizes the drag or scuffing of the sole plate on the grass which is characteristic of prior art clubs having solid sole plates.

Provisions are made for attachment of three weights, such as weights (26) to the underside of the club head in the relieved portions between ribs (22) and the face portion (13). The construction of the weights may best be seen in the cross-sectional view of FIG. 3. While these weights may take on many shapes, I prefer to utilize a counterbored weight (26) and a washer (28) held in counterbored recess (24) by mounting screw 30. By forming weights from several different materials such as lead, aluminum, steel, plastic, and the like, a wide range of weight adjustment is available. This allows the putter head of my invention to be adjusted to satisfy the preferences of a wide range of golfers.

Of more importance, however, is the use of the weights (26 and 28) to balance the club. With the shaft (21) in place, various size weights may be installed so as to produce both a fore and aft balance and longitudinal balance. The most important balance is fore and aft with respect to the line of the club shaft and may be very accurately obtained with my above described balancing means. However, many skilled golfers develop techniques which depend on a heel weight heavier than the toe weight or vice versa. Advantageously, the weight of the heel and toe portions of my putter head (12) may be independently adjusted by the individual user to satisfy such special requirements.

Turning now to sighting device (16), its construction will be apparent from FIG. 3. A cylindrical cavity (19) is provided in club head (12) and a thin disc (20) is disposed on the bottom surface of chamber (19). Preferably, disc (20) will have a flat black surface with a small white or silver spot in its center. The spot is formed to be about the same size as black spot (18) as seen in FIG. 1. At the top of cylindrical chamber (19), a transparent disc (17) is installed in a counterbore so as to be flush with the upper surface (10) of club head (12). For economy and durability, I prefer to utilize an acrylic plastic material or the like for disc (17). Disc (17) may have the pattern as shown in FIG. 1 attached to its top surface by means of a decal or the like.

FIG. 4 shows a rear view of club head (12) with imaginary line (31) defining the horizontal plane of the putter head.

The use of sighting device (16) will be described with reference to FIGS. 5 and 6. When a golfer lines up his putt, he will commonly use the stance such as shown in FIG. 8. He looks directly down at the ball represented by vertical dash line C. He then controls the angle at which he is holding the putter handle (21) so as to cause the lower silver spot on disc (20) to become conincidnet with upper black spot (18) which insures that the horizontal plane (13) of the club head (12) is exactly parallel with the surface of the putting green. This condition is easily and clearly apparent to the golfer since misalignment, as illustrated in FIG. 6, causes the lower silvered spot (32) to be clearly visible on its black background since the upper spot (18) is not covering it. In addition, the golfer may use the fore and aft cross hair to properly align the putter with the ball since this represents the proper area on club face (11) with which the ball should be struck.

Although I have described my sighting device (16) as applied to an improved putter head design, it will be obvious that the device may also be used with other clubs such as drivers. However, in installing the device in a driver, it is necessary to have the cylindrical cavity oriented so that the lower and upper spots are in coincidence when the golfer is holding the club at the correct orientation since he would not, in driving, be in a stance such as used for putting. When my sighting device is adapted for a driver or the like, the cross hairs may also include reticle marks (34) as seen in FIG. 7. An expert golfer using this application may find that he executes a straight drive position so that the lower spot (32) touches a selected reticle line, that he can thereby produce a slice or a hook as may be required for a particular shot. A less expert golfer who may have learned poor driving habits can also utilize the reticle by experimentally determining the proper off-center position of spot (32) to cure a natural hook or slice. Thus, my sighting device is a valuable aid for golfers of all skill levels. Of course, the reticle lines may also be used in the sight for putters to permit a golfer to deliberately pull or push the ball, or to compensate for previously acquired bad habits.

ALTERNATIVE EMBODIMENTS OF THE SIGHTING DEVICE

While I have shown a simple and effective sighting device design above, certain alternative designs may be preferred or useful and are considered to fall within the scope of my invention.

FIGS. 9 and 10 disclose an alternative sight (50) which will produce a very bright and glowing lower spot. Best seen in FIG. 10, sight (50), comprises cylindrical cavity (19) with a round tubular channel (51) having one end opening into the closed end of cylindrical cavity (19) concentric therewith and the other end opening through top surface (10) of the club head (12). A bundle of fiber optics (54) is disposed in channel (51). The top end (52) receives the ambient sunlight which emanates from end (53). Any of the previously described upper spot devices may be used although transparent disc (17) is indicated in FIG. 10. In FIG. 9, the upper disc is omitted to illustrate the bright spot formed by light from end (53).

Turning now to FIG. 11. a sighting device (16) is shown in which the upper transparent disc (40) has a convex shape to its underside. This construction has the advantage of causing the lower spot (32) on lower disc (20) to appear much farther away than the upper spot (18) due to the lens effect of disc (40) to produce a more sensitive indication which may be preferred by some golfers. The opposite effect of causing the lower spot (32) to appear at a closer distance may be achieved with the design shown in FIG. 12 in which upper disc (42) has a convex shape and may be prefered by others.

Another embodiment is illustrated by FIG. 13 in which a cylindrical cavity (46) is provide in club head (12) and a small cylindrical post (45) is attached to the closed end concentric with cylinder cavity walls (46). The top surface (44) of post (45) is blackened and the sides of post (45) are brightly polished. The bottom surface (47) of cylindrical chamber (46) is blackened while the inner walls of chamber (46) may be white. As may be recognized, when the club is properly aligned, the line of sight shown by arrow A will cause black spot (44) as seen in FIG. 14 to meld with the area (47) which is also black to give a clear indication of a level club. If the club is not being held level, then the line of sight such as indicated by arrow B will occur, producing the pattern shown in FIG. 15 in which the bright portion of post (45) is seen as well as a portion of wall (46).

FIGS. 16 and 17 show alternative patterns for the sight (16) of the preferred embodiment. In FIG. 16, a black ring (49) is provided having cross hairs and black outer ring (48). In this case, centering of silvered spot (32) in inner ring (49) indicated correct alighment. The design of FIG. 17 is identical to that shown in the preferred embodiment, but with the omission of the reticle lines which may be desired by some users.

Figure 19:
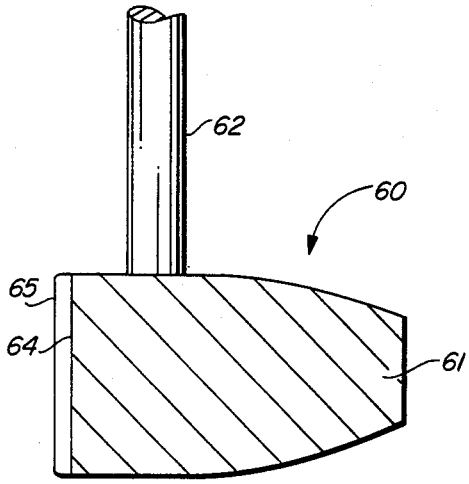
Figure 20:
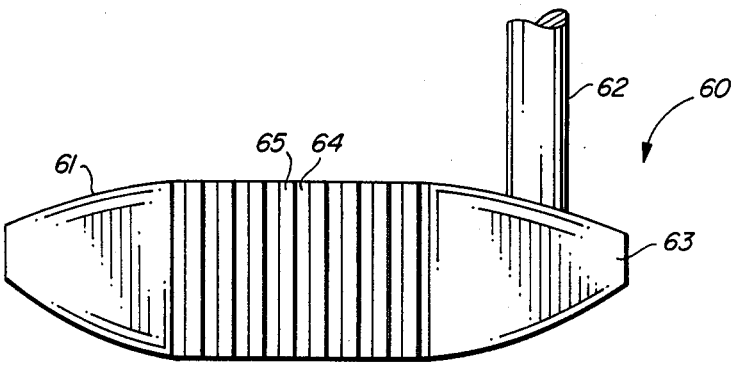

Turning to FIGS. 18 through 21, two additional embodiments of the golf club head are shown. In FIGS. 18 through 20, the golf club has a head 60 having a shaft 62 attached thereto and shaped in accordance with the embodiment shown in FIGS. 1 through 4, having a sight 67 placed on the top thereof mounted in an aperture 66. This embodiment also may have the removed portions forming ribs and the balancing weights as shown in FIGS 1 through 4. The golf club head 60 has a ball striking surface or face 63 having a plurality of vertical slots 64 therein forming a plurality of vertical impact ribs 65. The golf club head 60 has a rear portion 61 and end portion 63. The impact surface formed by the slots 64 and ribs 65 are cut into the face 63 of sufficient depth that upon striking a ball, the golf ball will impact only upon the rib surfaces 65 and not bottom into the slot 64. There is some significant compression of the ball surface on the face when a ball is impacted, so that fairly deep slots 64 are required for some clubs.

The vertical slots in accordance with this invention are used to reduce the impact surface area that is contacted by the golf ball and to thereby control the back-spin and skidding. The back-spin can be controlled by adjusting the width of the spacing of the slots. The slots will work effectively on putters and chippers and are not required to be in a vertical position since they are primarily to reduce the ball contact area for correct-spin. I have found that slots having a width of between 1/16 and ⅛ of an inch and spaced between 1/16 and ⅛ of an inch apart will substantially reduce back-spin and skidding and compensate for toe and heel shots. Thus, the embodiments of FIGS. 18 through 20 has reduced contact or impact with the golf ball by one half.

Figure 21:
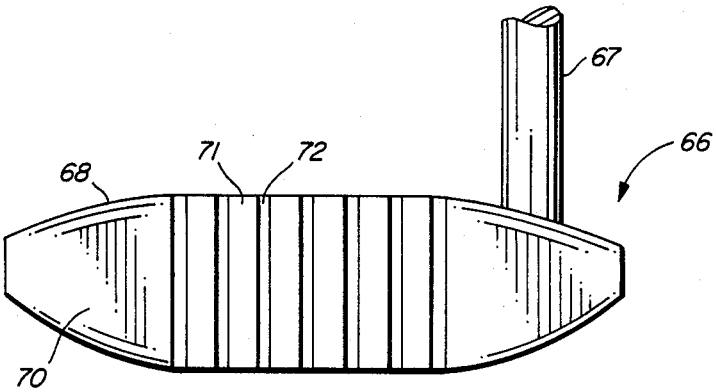

The embodiment of FIG. 21 has a golf club head 66 with shaft 67 and body 68 and a face 70. The face 70 has slots 72 formed therein and spaced by spacing ribs 71 across the center of the face 70 to reduce the contact area by about one-third. The substantial depth of the slot can be viewed in FIGS. 18 and 19, which have been made to prevent any contact from the golf ball with the bottom of the slots 64 and 7*b*. This improvement when used in conjunction with the sighting device 66 and 67 and the balancing weights and removed portions of FIGS. 1 through 4, provides for the control of a golf ball that has heretofore not been possible with putters.

It will, of course, be clear that while side spin is of less importance in low impact clubs such as putters, corrective spinning can be a useful secondary factor to compensate for outside in and inside out strokes which are unintentional and which correction is partially handled by the deep grooves or slots in the invention of FIGS. 18 through 21.

I claim:

1. A golf club head comprising:

a golf club head body having a front ball striking face thereon;

a plurality of recessed slots in said face, each slot being between 1/32 and ⅛ inch wide and of a depth to prevent the bottom of the slot from contacting a golf ball upon impact with said striking face, each slot extending substantially vertical across the center of said striking face, thereby reducing the contact area engaging a golf ball, said golf club head body having a horizontal plane normal to the striking face thereof;

sighting means disposed in a top surface of said golf club head for visually determining when said horizontal plane is parallel with the putting surface, said sighting means having an index adjacent the ball striking face; and said body having a sole plate extending rearwardly from the striking face and at least three relieved areas in said sole portion disposed rearwardly from said front striking face and extending to said rear edge, said relieved area defining at least two ribs forming the rearwardly extending portion of said sole plate, thereby minimizing the area of the sole plate which will be in contact with the surface during a stroke.

* * * * *